US005438945A

United States Patent [19]

Moody

[11] Patent Number: 5,438,945

[45] Date of Patent: Aug. 8, 1995

[54] SLIDE VALVE ASSEMBLY

[75] Inventor: Paul E. Moody, Barrington, R.I.

[73] Assignee: The United States of America as represented by the Secretary of the Navy, Washington, D.C.

[21] Appl. No.: 280,977

[22] Filed: Jul. 27, 1994

[51] Int. Cl.[6] ..... B63B 1/00

[52] U.S. Cl. ..... 114/238

[58] Field of Search ..... 114/238; 89/1.81; 251/35, 37, 47, 206, 207, 210

[56] References Cited

U.S. PATENT DOCUMENTS

| | | | |
|---|---|---|---|
| 4,848,210 | 7/1989 | Bissonnette | 114/238 |
| 5,044,253 | 9/1991 | Moody | 114/238 |
| 5,099,745 | 3/1992 | Hubbell et al. | 114/238 |
| 5,200,572 | 4/1993 | Bissonnette et al. | 114/238 |
| 5,210,369 | 5/1993 | Cassidy | 114/238 |
| 5,375,502 | 12/1994 | Bitsakis | 114/238 |

*Primary Examiner*—Stephen Avila

*Attorney, Agent, or Firm*—Michael J. McGowan; Prithvi C. Lall; James M. Kasischke

[57] ABSTRACT

There is presented a slide valve assembly comprising an impulse tank adapted to receive and retain fluid, under pressure and a fluid launch tube extending through the impulse tank, the fluid launch tube having openings therein adapted to be in communication with the impulse tank. The assembly further comprises a slide valve head slidably disposed in the impulse tank and adapted to move in the impulse tank between a first position in which the slide valve head covers the openings to prevent fluid flow between the impulse tank and the fluid launch tube, and a second position in which the slide valve head is removed from the openings to permit fluid flow between the impulse tank and the fluid launch tube. The assembly still further comprises a fluid flow resistance element fixed to the slide valve head and adapted, when covering the openings, to permit frictionally resisted flow of fluid therethrough.

8 Claims, 2 Drawing Sheets

SLIDE VALVE ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention relates to slide valves, and is directed more particularly to a slide valve of the type used for fluid communication between an impulse tank and a launch tube in an underwater vehicle, such as a submarine.

(2) Description of the Prior Art

It is known to use an impulse storage and transfer system in a submarine for ejection of devices from the submarine through launch tubes. In U.S. Pat. No. 4,848,210, issued Jul. 18, 1989 to Laurent C. Bissonnette, there is shown and described an impulse energy storage system having as a principal component thereof an elastomeric energy storage device. The elastomeric device is adapted to accept and store a working fluid such as seawater. In accepting the working fluid, the elastomeric means, a bladder-type accumulator, becomes distended. The accumulator typically is fixed to a slide valve assembly including (1) an impulse tank in fluid communication with the accumulator (2) a launch tube adapted to be in fluid flow communication with the impulse tank, and (3) a slide valve adapted to open and close fluid communication between the impulse tank and the launch tube.

Elastomeric ejection systems are being developed for the quiet ejection of torpedoes, mines or missiles, and such a system is inexpensive relative to existing ram pump and turbine pump types of weapon ejection systems.

Elastomeric launch systems operate in a generally satisfactory manner; however, at the end of the contraction of the accumulator, a noise is generated by the accumulator collapsing upon itself. In U.S. Pat. No. 5,200,572, issued Apr. 6, 1993, in the name of Laurent C. Bissonnette, et al., there is shown and described a configuration of elastomeric accumulator which eliminates or greatly reduces the operating noise of the accumulator.

While such systems therefore radiate relatively little noise upon launch of a weapon, another radiated noise source is present in these prior art systems. Upon weapon launch, a slide valve opens allowing a fluid, such as sea water, to flow quickly into the launch tube from the impulse tank. This sudden rush of fluid often causes a waterhammer and its associated noise in the launch tube.

In the continuing effort to reduce or eliminate noise associated with submarine weapon launches, there is a need for a slide valve which does not cause waterhammer noises during operation.

SUMMARY OF THE INVENTION

An object of the invention is, therefore, to provide a slide valve assembly including a slide valve having means for opening fluid flow between an impulse tank and a fluid receiver, such as a launch tube, in such a manner as to greatly reduce or eliminate waterhammer otherwise caused by sudden release of the high pressure fluid from the impulse tank into the fluid receiver.

A further object of the invention is to provide such a slide valve assembly located on the outside of the launch tube in lieu of the inside location of present slide valve assemblies.

With the above and other objects in view, as will hereinafter appear, a feature of the present invention is the provision of a slide valve assembly comprising an impulse tank adapted to receive and retain fluid under pressure, and a fluid launch tube extending through the impulse tank, the fluid launch tube having openings therein for communication with the impulse tank. The assembly further comprises a slide valve head slidably disposed in the impulse tank and adapted to move in the impulse tank between a first position in which the slide valve head covers the openings to prevent fluid flow between the impulse tank and the launch tube, and a second position in which the slide valve head is removed from the openings to permit fluid flow between the impulse tank and the fluid receiver tube. The assembly still further comprises a fluid flow resistance element fixed to the slide valve head and adapted, when covering the openings, to permit frictionally resisted flow therethrough.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of the invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
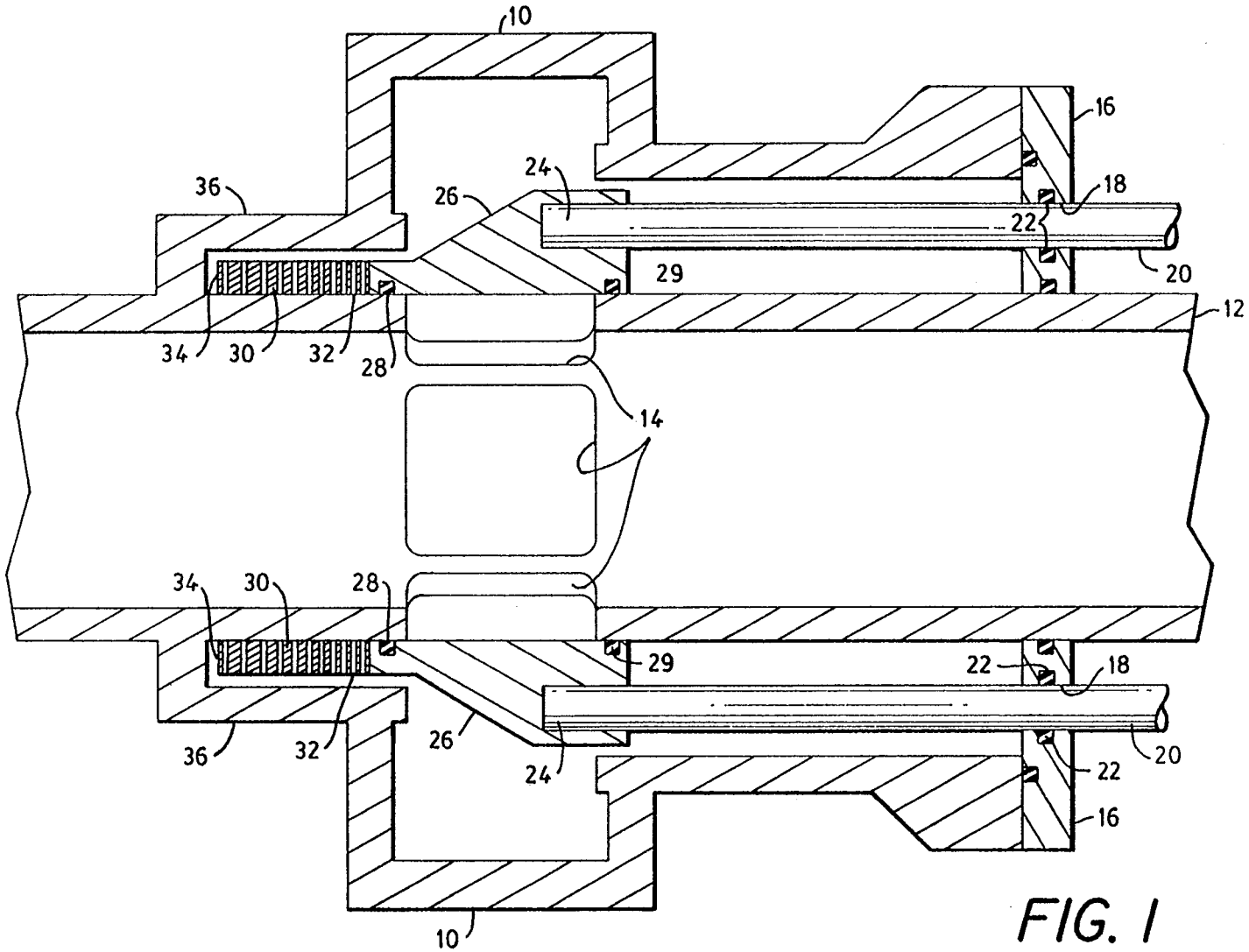
FIG. 1 is a diagrammatic sectional view of a slide valve assembly illustrative of an embodiment of the invention.

Referring to FIG. 1 of the drawings, it will be seen that the illustrative slide valve assembly includes an impulse tank 10. The impulse tank 10 is in fluid communication with an elastomeric accumulator (not shown) or other source of fluid, such as seawater, under pressure. Extending centrally through impulse tank 10 is a fluid receiver, such as a launch tube 12 in which may be disposed a missile or other device (not shown) to be ejected from the launch tube 12. Launch tube 12 is provided with openings 14 arranged in line around the circumference of the launch tube. An end wall 16 of impulse tank 10 is provided with at least one bore 18 in which is slidingly disposed an actuator rod 20. Each bore 18 is provided with water-tight seals 22.

Fixed to an end 24 of rod 20 is a slide valve head 26, which is annularly shaped and configured and adapted to cover all the openings 14, as shown in FIG. 1, to prevent fluid communication between impulse tank 10 and launch tube 12. The valve head 26 is provided with water tight seals 28, 29.

Fixed to one end of valve head 26 is a collar-shaped fluid flow resistance element 30 which includes a large number of baffles defining a large number of flow paths through the element, such that while element 30 permits flow therethrough, it resists such flow by imposing a multitude of flow-resisting baffles in what otherwise would be an unimpeded open flow path. Preferably, the flow resisting element 30 includes baffles, or baffle-like members, more densely compacted at an end 32 adjacent valve head 26, with the density of the baffles decreasing toward a free end 34 of element 30. Element 30 accordingly forms a extension of valve head 26, with the element being more resistant to flow therethrough near the valve head, with points thereon removed further and further from the valve head having, respectively, less and less resistance to flow therethrough.

In the position shown in FIG. 1, valve assembly valve head 26 completely covers openings 14. Sealing rings 28, 29 prevent escape of fluid into openings 14. Fluid flow resistance element 30 rests in a pocket portion 36 of impulse tank 10. In this position, impulse tank 10 and launch tube 12 are not in fluid communication.

Figure 2:
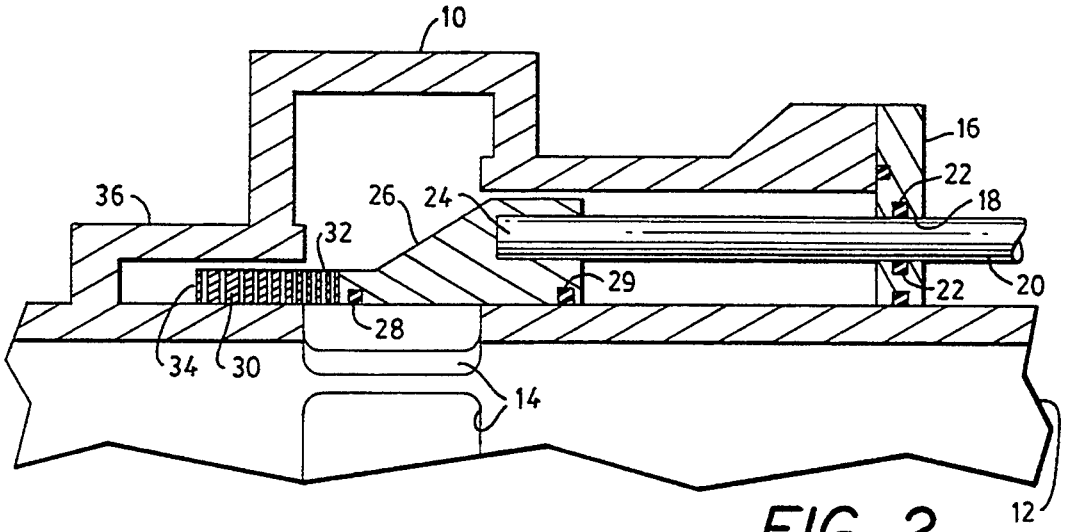
FIG. 2 is a diagrammatic sectional view of a portion of the slide valve assembly of FIG. 1, with the slide valve component of the assembly shown in a different operative position.
Figure 3:
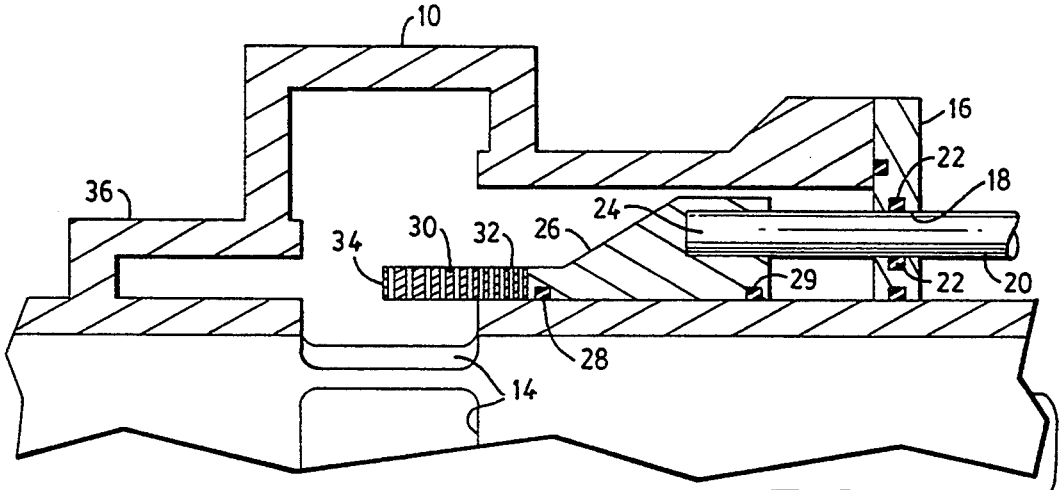
FIGS. 3 and 4 are diagrammatic sectional views, similar to FIG. 2, showing the slide valve component of the slide valve assembly in further operative positions.

To initiate launch of a weapon in launch tube 12, actuator rod 20 is caused to move to the right, as viewed in FIGS. 1–4, causing valve head 26 to move rightwardly. Upon passage of sealing ring 28 from a position fully in engagement with launch tube 12, to a position over openings 14, water starts finding its way from impulse tank 10 into launch tube 12, but the flow is resisted by denser end 32 of element 30. Referring to FIG. 2, it will be seen that in short order valve head 26 is completely removed from launch tube portions to the left of openings 14, as viewed in the drawings. However, the portions of openings 14 not covered by valve head 26 are still covered by a denser portion of element 30. Shortly thereafter (FIG. 3), less dense portions of element 30 are disposed over openings 14, permitting a greater rate of fluid flow into the launch tube. As element 30 moves rightwardly, flow through openings 14 becomes progressively less impeded. In due course, valve head 26 and element 30 are completely removed from openings 14, permitting unobstructed flow through openings 14.

Figure 4:
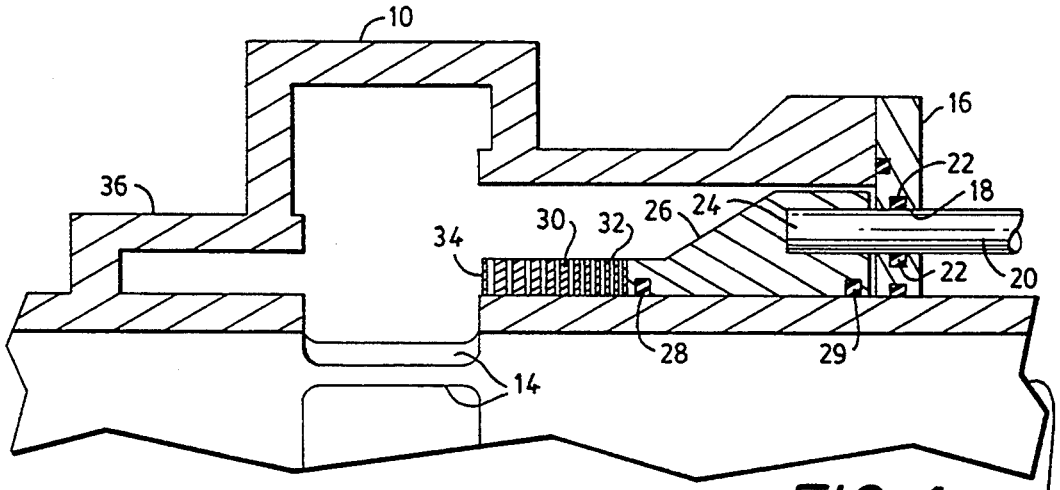

When desired, the valve head 26 and element 30 are moved from the position shown in FIG. 4 to the position shown in FIG. 1, and the impulse tank and accumulator in communication therewith are charged for another launch operation.

Thus, there is provided means for admitting fluid to the launch tube in a progressive manner, eliminating the waterhammer associated with the more instantaneous admission of fluid heretofore practiced. Further, only modifications to presently-used slide valves, by relocating them to the outside of the launch tube and by way of addition of element 30, and impulse tanks, by way of addition of pocket portion 36, are necessary to make the new launch mechanism available to a future submarine design.

It is to be understood that the present invention is by no means limited to the particular construction herein disclosed and/or shown in the drawings, but also comprises any modifications or equivalents within the scope of the claims.

What is claimed is:

1. A slide valve assembly comprising:

a tank adapted to receive and retain fluid under pressure;

a fluid launch tube having openings therein adapted to be in communication with said tank;

a slide valve head adapted to slidingly move between a first position in which said slide valve head covers said openings to prevent fluid flow between said tank and said tube, and a second position in which said slide valve head is removed from said openings to permit fluid flow between said tank and said tube; and a fluid flow resistance element fixed to said slide valve head, said flow resistance element comprising a series of baffle-like members, and adapted, when covering said openings, to permit frictionally resisted flow of fluid between said baffle-like members.

2. A slide valve assembly comprising:

a tank adapted to receive and retain fluid under pressure;

a fluid launch tube having openings therein adapted to be in communication with said tank;

a slide valve head adapted to slidingly move between a first position in which said slide valve head covers said openings to prevent fluid flow between said tank and said tube, and a second position in which said slide valve head is removed from said openings to permit fluid flow between said tank and said tube; and a fluid flow resistance element fixed to said slide valve head and adapted, when covering said openings, to permit frictionally resisted flow of fluid therethrough, wherein said fluid flow resistance element is fixed to one end of said valve head and has most flow resistance at an end of said element near said valve head one end and has progressively less flow resistance at points progressively removed from said valve head one end.

3. A slide valve assembly comprising:

an impulse tank adapted to receive and retain fluid under pressure;

a fluid launch tube extending through said impulse tank, said fluid receiver tube having openings therein adapted to be in communication with said impulse tank;

a slide valve head slideably disposed in said impulse tank and adapted to move in said impulse tank between a first position in which said slide valve head covers said openings to prevent fluid flow between said impulse tank and said fluid launch tube, and a second position in which said slide valve head is removed from said openings to permit fluid flow between said impulse tank and said fluid launch tube; and a fluid flow resistance element fixed to said slide valve head and adapted, when covering said openings, to permit frictionally resisted flow of fluid through walls of said resistance element.

4. A slide valve assembly comprising:

an impulse tank adapted to receive and retain fluid under pressure;

a fluid launch tube extending through said impulse tank, said fluid receiver tube having openings therein adapted to be in communication with said impulse tank;

a slide valve head slideably disposed in said impulse tank and adapted to move in said impulse tank between a first position in which said slide valve head covers said openings to prevent fluid flow between said impulse tank and said fluid launch tube, and a second position in which said slide valve head is removed from said openings to permit fluid flow between said impulse tank and said fluid launch tube; and a fluid flow resistance element fixed to said slide valve head and adapted, when covering said openings, to permit frictionally resisted flow of fluid therethrough, wherein said fluid flow resistance element is fixed to one end of said valve head and has most flow resistance at one end of said element near said valve head one end and has progressively less flow resistance at points progressively removed from said valve head one end.

5. The slide valve assembly in accordance with claim 4 wherein said launch tube is circular and disposed within said tank.

6. The slide valve assembly in accordance with claim 5 wherein said openings are in alignment around the circumference of said launch tube and said valve head and fluid flow resistance element are cylindrically-shaped and slidable on the exterior of said tube.

7. The slide valve assembly in accordance with claim 6 wherein said valve head is fixed to an activator rod which extends through a bore in a wall of said tank.

8. The slide valve assembly in accordance with claim 4 wherein said tank is provided with a pocket portion for receiving said fluid flow resistance element when said valve head extends over said openings.

* * * * *